United States Patent [19]

Mitchell et al.

[11] 4,145,784

[45] Mar. 27, 1979

[54] TIMED EJECTOR FOR A HEADER

[75] Inventors: Robert F. Mitchell, Watertown; Donald A. Roy, Waterbury, both of Conn.

[73] Assignee: Textron Inc., Providence, R.I.

[21] Appl. No.: 833,669

[22] Filed: Sep. 15, 1977

[51] Int. Cl.[2] ..... B21D 45/00; B21K 1/46

[52] U.S. Cl. ..... 10/11 E; 72/427

[58] Field of Search ..... 10/11 A, 11 E, 12 R, 10/12.5, 11 R, 15; 72/427

[56] References Cited

U.S. PATENT DOCUMENTS

| | | | |
|---|---|---|---|
| 2,547,304 | 4/1951 | Broscomb | 10/11 E |
| 3,127,626 | 4/1964 | Friedman | 10/12.5 |
| 3,238,761 | 3/1966 | Hoyt | 10/11 R |
| 3,266,071 | 8/1966 | Nebendorf | 10/11 R |
| 3,299,453 | 1/1967 | Van De Meerendonk | 10/12 R |
| 3,802,013 | 4/1974 | Nebendorf et al. | 10/11 E |
| 3,820,376 | 6/1974 | Koch et al. | 72/427 |
| 4,091,486 | 5/1978 | Kalt | 10/11 E |

*Primary Examiner*—E. M. Combs

*Attorney, Agent, or Firm*—DeLio and Montgomery

[57] ABSTRACT

An ejector mechanism associated with the punch or punches in a header, operable to free the work blank from the punch after a heading blow so that the blank may remain in the die for a further forming blow, the mechanism including timing means to insure actuation of the ejector at the moment when the punch starts its withdrawal movement, as well as clearing of the ejector to prevent transmission of a load to the ejector mechanism on the heading blow.

10 Claims, 6 Drawing Figures

AIR SUPPLY

TIMED EJECTOR FOR A HEADER

This invention relates to an ejector mechanism associated with the punch or punches in a header, operable to free the work blank from the punch after a heading blow so that the blank may remain in the die for a further forming blow, the mechanism including timing means to insure actuation of the ejector at the moment when the punch starts its withdrawal movement, as well as clearing of the ejector to prevent transmission of a load to the ejector mechanism on the heading blow.

It is frequently observed that when blanks are encompassed by the punch in a first or subsequent heading blow the newly formed head tends to stick to the punch, which thus withdraws the blank from the die when the gate recedes. This is a serious matter in cases where another blow by a different punch is supposed to be delivered to the blank in the same die.

It is accordingly an object of the present invention to provide the punch with ejecting means for keeping the blank in the die when the punch is withdrawn with the gate.

It is a further object of the invention to provide means for properly timing the actuation of the ejecting means.

It is another object of the invention to avoid transmission of a load to the ejection mechanism on the heading blow.

It is yet another object of the invention to provide a refinement of and improvement over the elementary punch knock-out mechanism disclosed in Hoyt U.S. Pat. No. 3,238,761.

It is a still further object of the invention to provide certain improvements in the form, construction and arrangement of the several parts whereby the above-named and other objects may effectively be attained.

The invention accordingly comprises the features of construction, combination of elements, and arrangement of parts which will be exemplified in the constructions hereinafter set forth, and the scope of the invention will be indicated in the claims.

A practical embodiment of the invention is represented in the accompanying drawings wherein:

FIG. 6 represents a detail vertical section, in the plane of FIGS. 4, 3 and 1, showing the die, punch, ejector and work blank at an early stage in the operation.

Figures 1, 5:
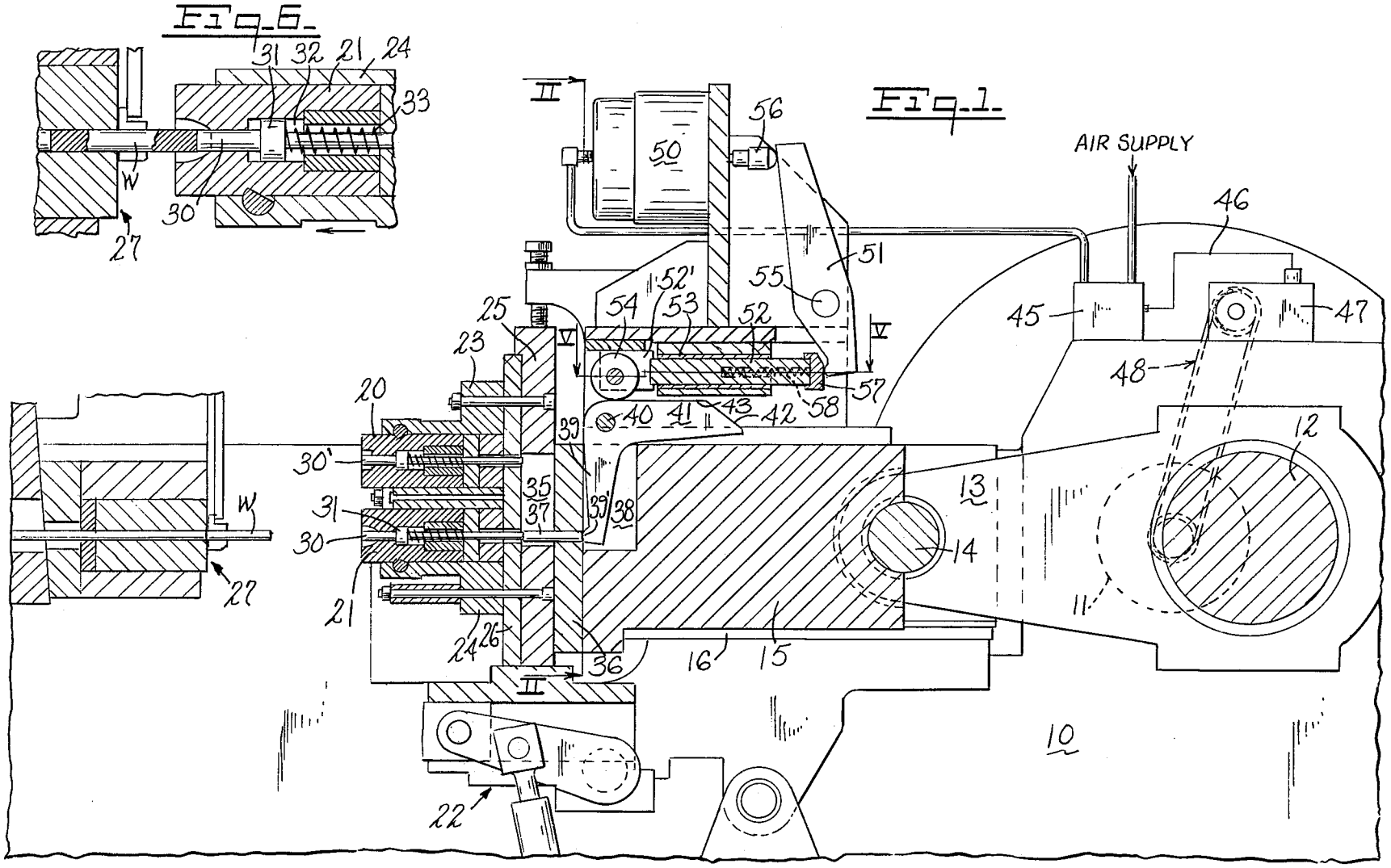
FIG. 1 represents a vertical section of the pertinent punch and die mounting and operating elements substantially on the center line of a two or four blow vertical shifter header, parts being broken away and unnecessary parts being omitted.
FIG. 5 represents a detail horizontal section on the line V—V of FIG. 1.
Figure 4:
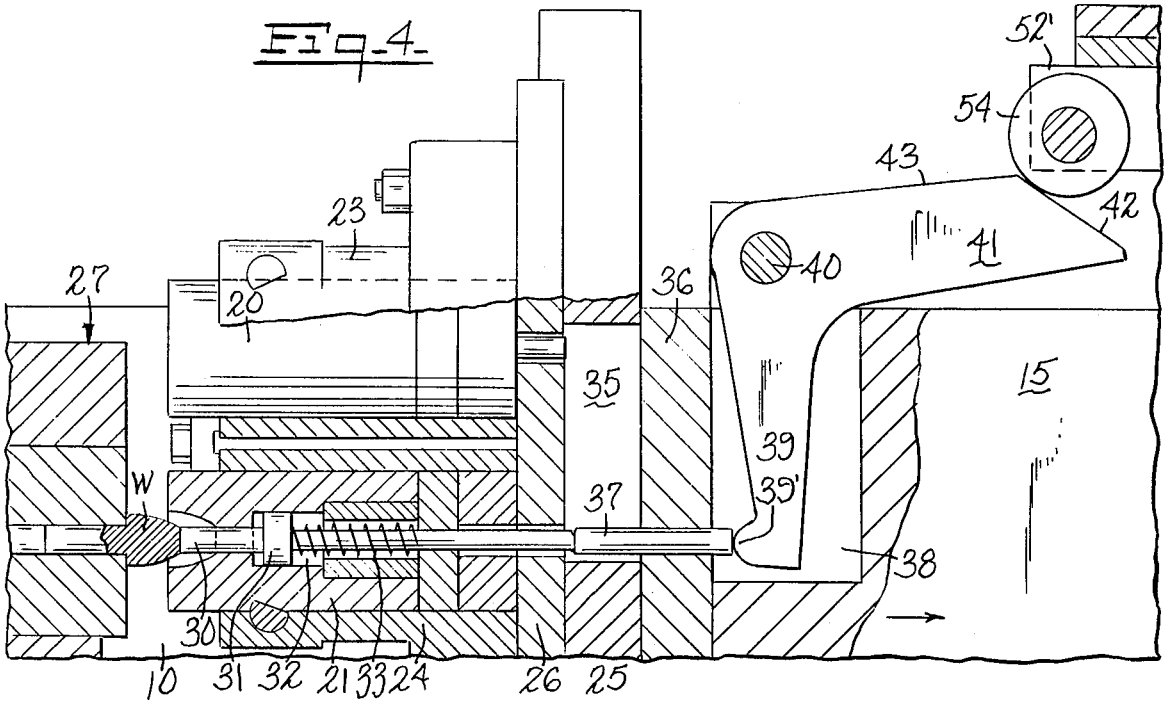
FIG. 4 represents a detail vertical section, in the plane of FIGS. 3 and 1, showing the punch slightly retracted.

Referring to the drawings, there is shown an apparatus comprising a supporting frame 10 in which is mounted a main crankshaft 11 having a crank portion 12 thereon. The shaft may be driven from any suitable driving means, not shown. Upon the crank portion 12 is a pitman 13 connected by a crank pin 14 to a ram or gate 15 which is slidable on the fixed guideway 16. Means for effecting vertical reciprocation of the punches 20,21 is indicated generally at 22, punch holders 23,24 being mounted on a punch slide 25 with the interposition of a backing plate 26. A die 27, of conventional construction, is mounted on the frame in a customary manner and with customary accessories.

Each punch is provided with a knockout pin 30 having a flange 31 which is freely slidable in the enlarged bore 32 of the punch and is biased toward the forward (knockout) position by a spring 33. The slide 25 is provided with an elongated opening 35, the vertical dimension of which is sufficient to expose the rear ends of both upper and lower knockout pins, which ends at rest are approximately in the plane of the rear face of the backing plate. A front plate 36 on the gate is traversed by a bore in which the short push rod 37 is slidably mounted, and the front face of the gate is recessed at 38 to accommodate the lower (vertical) arm 39 of the gate knockout lever which is pivoted on the gate at 40. The upper (horizontal) arm 41 of the lever has an upper surface which includes a ramp portion 42 and a flat portion 43. The arm 39 terminates in a nib 39' adapted to bear against the inner end of the push rod 37 which, in turn, is aligned with the knockout pin 30. The elements 30 to 43, just described, are all carried directly or indirectly by the gate and reciprocate horizontally.

Mounted on the frame of the machine are the roto-chamber 50, the rocker 51 and the slide 52 horizontally movable in the slide tube 53, the slide having a roll 54 journaled in a clevis 52' on its forward end. The rocker is pivoted at 55 and is adapted to translate rearward movement of the roto-chamber drive rod 56 into forward movement of the slide, through contact of the lower end of the rocker with the slide cap 57. The slide assembly is urged rearwardly by pairs of compression springs 58 between the rear of tube 53 and the cap. The roto-chamber is a pneumatic chamber actuated by a solenoid air valve 45 which is energized through conductor 46 by a proximity switch on cam limit switch 47 which can be mounted at any convenient point on the frame and actuated, for instance, by a chain and sprocket drive 48 from the crankshaft 11 whereby the end of a heading stroke can be observed and anticipated.

The relation of the roll 54 to the ramp 42 and surface 43 is such that, in the closed position of the gate (FIG. 3), the roll 54 is near but not touching the ramp, while the gate knockout lever (39-41) is tilted (by rearward movement of pin 30 and rod 37) to raise the ramp into the path of travel of the roll. When the gate moves to its open position (FIG. 1) the ramp contacts the roll 54 which forces down the arm 41, permitting the roll to move along the surface 43 and causing the knockout pin 30 to reach its full ejection position. On the heading stroke of the gate, the knockout pin is freed from the constraint of the knockout lever as soon as the top of the ramp starts to pass under the roll; the workpiece W is thus able to push in freely the knockout pin as the punch performs its heading function (FIG. 6).

Figures 3, 5:
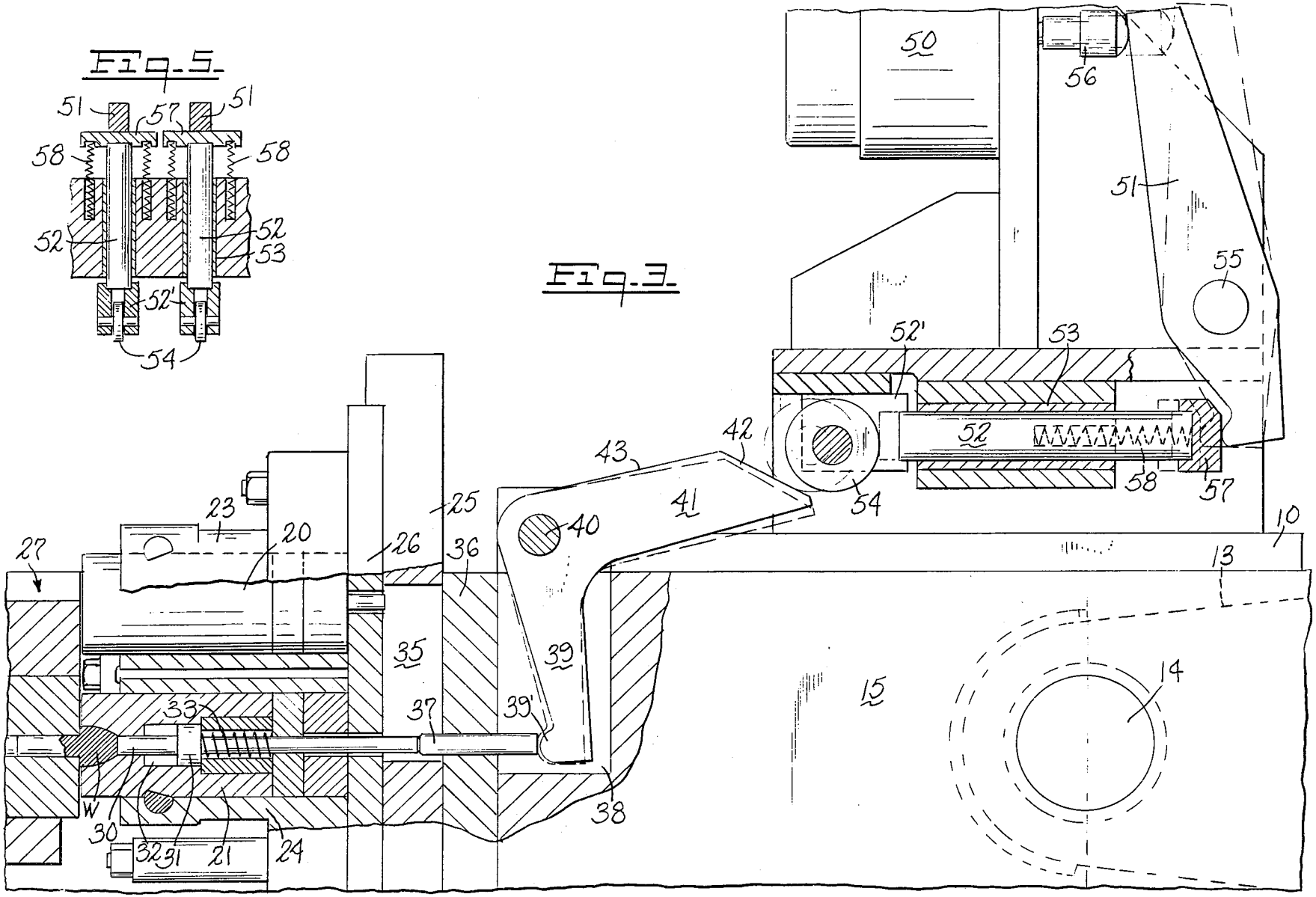
FIG. 3 represents a detail vertical section in the plane of FIG. 1, with the parts in a different position, the punch being advanced.

At or slightly before the end of the heading stroke, the proximity switch responds to the juxtaposition of the moving and stationary parts of the machine, energizing the solenoid air valve which actuates the roto-chamber drive rod 56 to advance the slide 52 and its roll 54 (broken line position in FIG. 3). The movement of the ramp 42 against the roll immediately biases the knockout pin in its work-ejecting direction, this effect being timed to coincide with the completion of the heading blow and the force thus applied to the knockout pin being sufficient to prevent the workpiece from sticking in the punch. This resilient ejecting force is released when the ejection of the blank is completed, but positive ejection movement of the pin follows as the gate is withdrawn and the arm 41 is moved beneath the roll.

Figure 2:
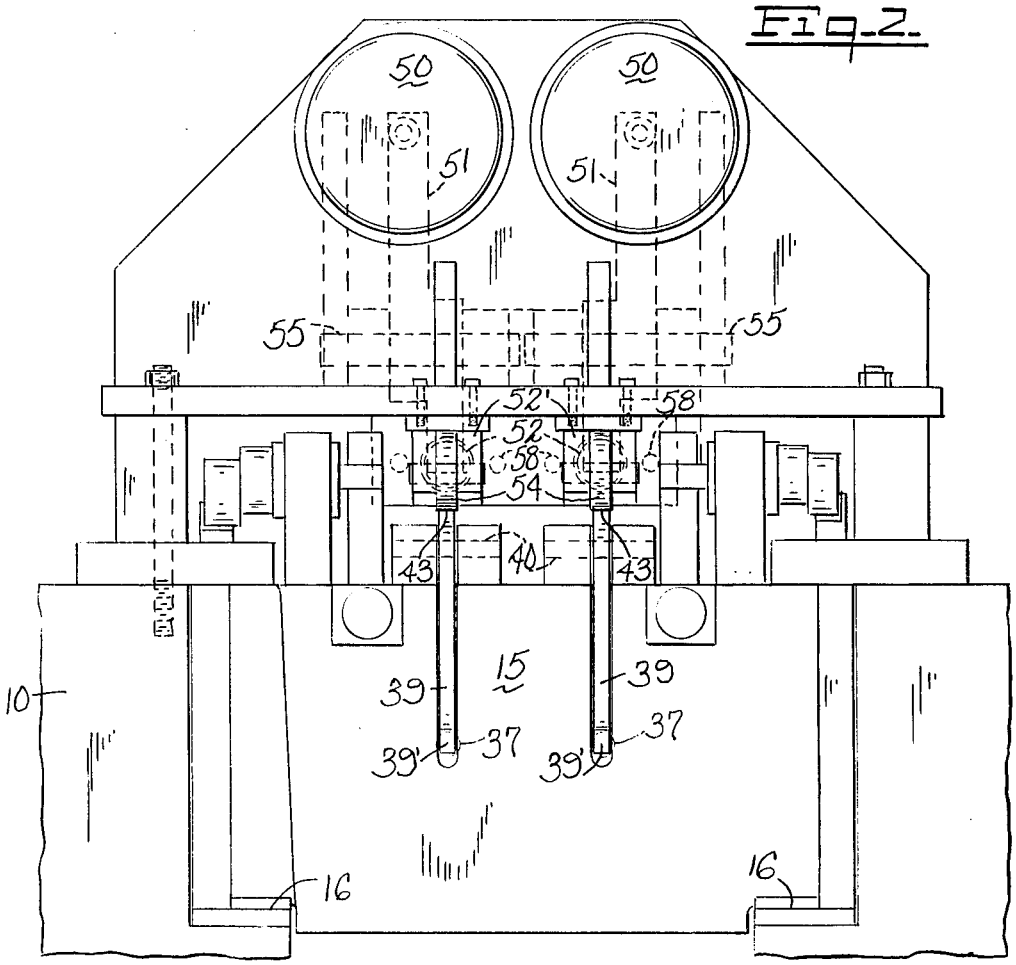
FIG. 2 represents a transverse vertical section on the line II—II of FIG. 1.

The description herein has been directed to the operation of parts associated with only one of the punches, but it will be understood that such parts are duplicated, as indicated in FIGS. 2 and 5 if the header includes two pairs of vertically movable punches. It will also be noted that reference has been made particularly to the punch 21 which is in the lower position, as shown in FIGS. 1 and 3. When the punch 20 is lowered to its operative position, its knockout pin 30' registers with the push rod 37 and the punch-clearing operation is carried out as described.

That is, the next punch (20) comes into position, the gate again comes forward to head the blank again in the same die, the knockout lever moves back toward the roll but only moves the amount that the blank enters the punch, this movement being so small that the knockout lever does not move back far enough to bring the ramp 42 into contact with the roll. There is thus no load on the knockout pin or lever or the ejector system during the header blow. At or near the end of the heading cycle the roto-chamber is again actuated as described above, to effect positive ejection of the workpiece from the second punch. If the heading is then complete, the workpiece will be ejected from the die in the usual manner.

An important feature is that after a certain amount of metal in the head of the part has been "mushroomed" on the heading blow, the punch knockout lever and pin adjust for this change of length because the cylinder causes it to move until lever, knockout pin and workpiece all make contact. This is an important distinguishing feature over prior devices since in the existing systems the workpiece may remain in the punch until it contacts the knockout pin for ejection. In the present mechanism the automatic adjustment has the knockout pin in contact with the workpiece thereby keeping the workpiece from sticking in the punch as the punch recedes from the die.

From the foregoing it will be appreciated that exact timing of the sequence of operations is essential. Throughout most of the complete cycle, the knockout pin projects into the punch cavity. When the punch approaches the work, as for a heading operation, the workpiece contacts the front end of pin 30, forcing it to retract until its flange 31 bottoms. At this point the front end of pin 30 forms the bottom of the mushroom cavity (FIG. 3) and this is permitted by movement of the ramp 42 forwardly, beyond the retracted position of the roll 54. As the punch and ejector pin 30 continue to the extreme forward position a gap occurs between the back end of pin 30 and punch rod 37 thus freeing the ejector mechanism from the heading load. It is then important to apply a work-ejecting force to the pin at or before the instant when the punch starts to retract, and this is effected by the momentary advancement of the roll to "take up the gap" and apply resilient pressure to the head of the workpiece at the instant when it might tend to be dislodged from the die. The roto-chamber need be operated only for an instant, since the retraction of the gate almost immediately causes normal operation of the knockout pin as described above.

To summarize, in existing ejector mechanisms the workpiece, after heading, can retract from the die a distance equal to the amount the workpiece has been mushroomed in the punch cavity. This is due to the fact that the workpiece extends beyond the face of the die a greater distance before mushrooming in the punch cavity than after mushrooming is completed. In existing ejectors the punch, ejector pin and workpiece retract until the ejector pin contacts the ejector push rod.

In this design the ejector push rod moves forward, due to the timed pneumatic drive, and contacts the workpiece at the extreme forward position thereby eliminating any retraction of the workpiece from the die.

It may thus be seen that the objects of the invention set forth as well as those made apparent from the foregoing description are efficiently attained. While preferred embodiments of the invention have been set forth for purposes of disclosure and modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

We claim:

1. In a header, an ejection mechanism associated with a punch, comprising a knockout pin, mechanical means for positive actuation of said pin after each heading blow and additional means for actuating the knockout pin resiliently at approximately the moment when a heading blow is completed and before the punch starts to withdraw, said additional means including a first biasing means, mechanical linkage adapted to connect said biasing means to the knockout pin and timed activating means operable to momentarily effect such connection.

2. A mechanism according to claim 1 which includes a second biasing means constantly urging the knockout pin toward its knockout position.

3. A mechanism according to claim 2 wherein the knockout pin is freely retractable into the punch against the force of said second biasing means, by the entrance of a workpiece into the punch cavity during the heading blow.

4. A mechanism according to claim 1 wherein the first biasing means is pneumatically driven as a function of the position of the punch in relation to the die.

5. A mechanism according to claim 4 wherein the first biasing means is a roto-chamber having a pneumatically actuated drive rod and the mechanical linkage includes a rocker adapted to be moved by the drive rod, a slide movable by the rocker, a lever adapted to advance the knockout pin and a roll on the slide in a position to actuate said lever when the rocker moves the slide.

6. A mechanism according to claim 5 wherein the lever is a bell-crank lever one arm of which terminates in a ramp so located that it is advanced out of contact with the roll at the end of the heading blow.

7. A mechanism according to claim 6 which includes a push rod adapted for alignment with the knockout pin, and a second arm of the bell-crank lever being operatively engageable with the knockout pin.

8. A mechanism according to claim 5 wherein the header includes a frame, a gate and drive means for reciprocating the gate, the roto-chamber, rocker, slide and roll being mounted on the frame, and the lever and knockout pin being mounted on the gate.

9. A mechanism according to claim 5 which includes resilient means biasing the slide and rocker to a position such that the drive rod is retracted.

10. A mechanism according to claim 7 wherein the header is a vertical shifting two-blow or four-blow header with two vertically aligned punches, each having a knockout pin, the push rod being adapted for alignment selectively with either of said pins according to the position of the punches.

* * * * *